United States Patent [19]

Carr et al.

[11] 4,203,823

[45] May 20, 1980

[54] COMBINED COAL LIQUEFACTION-GASIFICATION PROCESS

[75] Inventors: Norman L. Carr, Allison Park; Ronald Schleppy, Jr., Pittsburgh, both of Pa.; Bruce K. Schmid, Denver, Colo.; Yatish T. Shah, Pittsburgh, Pa.

[73] Assignee: Gulf Research & Development Company, Pittsburgh, Pa.

[21] Appl. No.: 921,338

[22] Filed: Jul. 3, 1978

[51] Int. Cl.[2] ..... C10G 1/06; C10J 3/00

[52] U.S. Cl. ..... 208/10; 48/210

[58] Field of Search ..... 208/10; 48/210

[56] References Cited

U.S. PATENT DOCUMENTS

| | | | |
|---|---|---|---|
| 3,671,418 | 6/1972 | Gatsis | 208/10 |
| 3,884,794 | 5/1975 | Bull et al. | 208/8 |
| 3,884,796 | 5/1975 | Hinderliter et al. | 208/8 |

OTHER PUBLICATIONS

The SCR-II Process, paper presented at the 3rd Annual International Conference on Coal Gasification and Liquefaction, U. of Pitt., Aug. 3-5, 1976, B. K. Schmid & D. M. Jackson, Gulf Mineral Resources Co., 1720 Bellaire, Denver, Co. 80222.

*Primary Examiner*—Delbert E. Gantz
*Assistant Examiner*—William G. Wright

[57] ABSTRACT

This invention relates to a combination coal liquefaction-gasification process wherein hydrocarbonaceous mineral residue-containing slurry from the liquefaction zone is recycled to the liquefaction zone and all non-recycled hydrocarbonaceous mineral residue-containing slurry is passed to a gasification zone for conversion to synthesis gas to supply hydrogen for the liquefaction zone. It has now been discovered that in this process a surprisingly high reaction selectivity in favor of the desired distillate oil product is achieved by combining low liquefaction zone residence times and relatively high rates of recycle of mineral residue-containing slurry compared to feed coal rate. Under these conditions the yield of the desired distillate oil product can be increased to an unexpectedly high level while the yields of both higher and lower boiling products are each being decreased and while hydrogen consumption is being reduced.

22 Claims, 7 Drawing Figures

Figure 1:
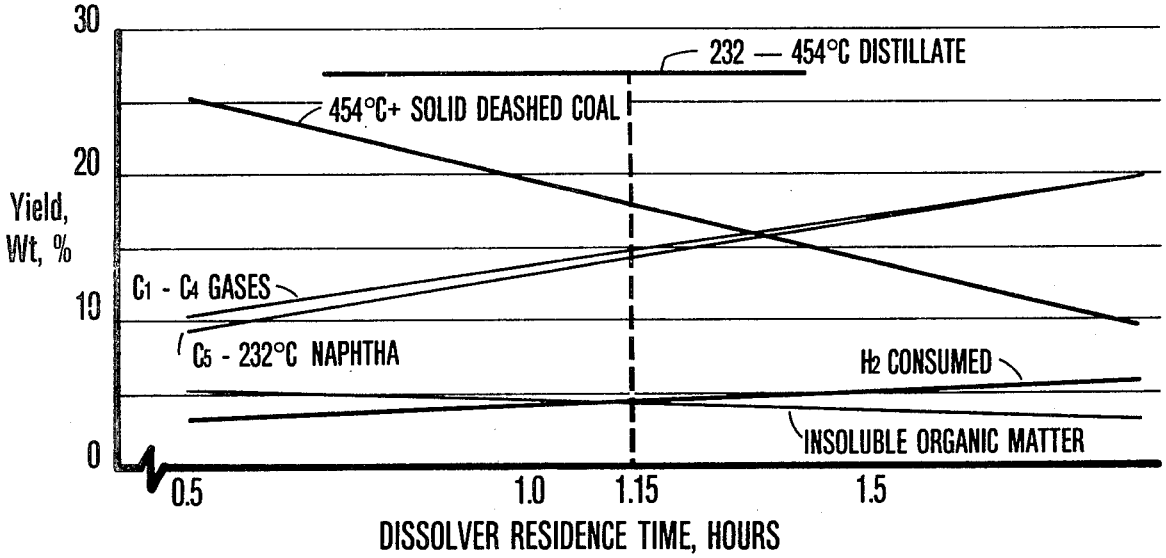

COAL LIQUEFACTION PROCESS
UNCOUPLED WITH A GASIFIER

COUPLED COAL LIQUEFACTION-
GASIFICATION PROCESS

EFFECT OF CHANGES IN FEED COAL CONCENTRATION AT CONSTANT RECYCLE SLURRY CONCENTRATION

EFFECT OF CHANGES IN RECYCLE SLURRY CONCENTRATION AT CONSTANT FEED COAL CONCENTRATION

EFFECT OF CHANGES IN FEED COAL CONCENTRATION AT A CONSTANT TOTAL OF FEED COAL AND RECYCLE SLURRY

COMBINED COAL LIQUEFACTION-GASIFICATION PROCESS

This invention relates to a combination process including coal solvent liquefaction and oxidative gasification zones. The entire feed to the gasification zone comprises a slurry containing dissolved coal and suspended mineral residue from the liquefaction zone. Hydrogen derived from the gasification zone is consumed in the liquefaction zone.

All of the raw feed coal for the combination process is supplied directly to the liquefaction zone and essentially no raw feed coal or other raw hydrocarbonaceous feed is supplied directly to the gasification zone. The feed coal can comprise bituminous or subbituminous coals or lignites. The liquefaction zone of the present process can comprise an endothermic preheating step in which hydrocarbonaceous material is dissolved from mineral residue in series with an exothermic dissolver or reaction step in which said dissolved hydrocarbonaceous material is hydrogenated and hydrocracked to produce a mixture comprising hydrocarbon gases, naphtha, dissolved liquid coal, normally solid dissolved coal and mineral residue. The temperature in the dissolver becomes higher than the maximum preheater temperature because of the exothermic hydrogenation and hydrocracking reactions occurring in the dissolver. Residue slurry from the dissolver or from any other place in the process containing solvent liquid and normally solid dissolved coal with suspended mineral residue is recirculated through the preheater and dissolver steps. Gaseous hydrocarbons and liquid hydrocarbonaceous distillate are recovered from the liquefaction zone product separation system. A portion of the mineral-containing residual slurry from the dissolver step can be recycled, and the remainder passed to atmospheric and vacuum distillation towers. All normally liquid and gaseous products are removed overhead in these towers and are therefore mineral-free while the vacuum tower bottoms (VTB) comprises the entire net yield of normally solid dissolved coal and mineral residue from the liquefaction zone.

Normally liquid dissolved coal product boiling in the range 450° to 850° F. (232° to 454° C.) is referred to herein by the terms "distillate liquid" and "liquid coal", both terms indicating dissolved coal which is normally liquid at room temperature, including process solvent. The VTB slurry which is gasified contains the entire net yield of inorganic mineral matter and undissolved organic material (UOM) from the raw coal, which together is referred to herein as "mineral residue". The amount of UOM will always be less than 10 or 15 weight percent of the feed coal. The VTB slurry which is gasified also contains the entire net yield of the 850° F.+(454° C.+) dissolved coal from the liquefaction zone. The 850° F.+(454° C.+) dissolved coal is normally solid at room temperature and is referred to herein as "normally solid dissolved coal". Non-recycled VTB slurry is passed in its entirety without any filtration or other solids-liquid separation step and without a coking or other step to destroy the slurry, to a partial oxidation gasification zone adapted to receive a slurry feed for conversion to synthesis gas, which is a mixture of carbon monoxide and hydrogen. The slurry is the only carbonaceous feed supplied to the gasification zone. An oxygen plant is provided to remove nitrogen from the air supplied to the gasifier so that the synthesis gas produced is essentially nitrogen-free.

At least a portion of the synthesis gas is subjected to a shift reaction for conversion to hydrogen and carbon dioxide. The carbon dioxide, together with hydrogen sulfide, is then recovered in an acid gas removal system. Essentially all of the gaseous hydrogen-rich stream so produced is consumed as process hydrogen in the liquefaction zone. Process hydrogen can also be obtained from the synthesis gas by passing the synthesis gas through a cryogenic or adsorption unit to separation a hydrogen-rich stream from a carbon monoxide-rich stream. The hydrogen-rich stream is utilized as process hydrogen and the carbon monoxide-rich stream can be utilized as process fuel.

Figure 2:
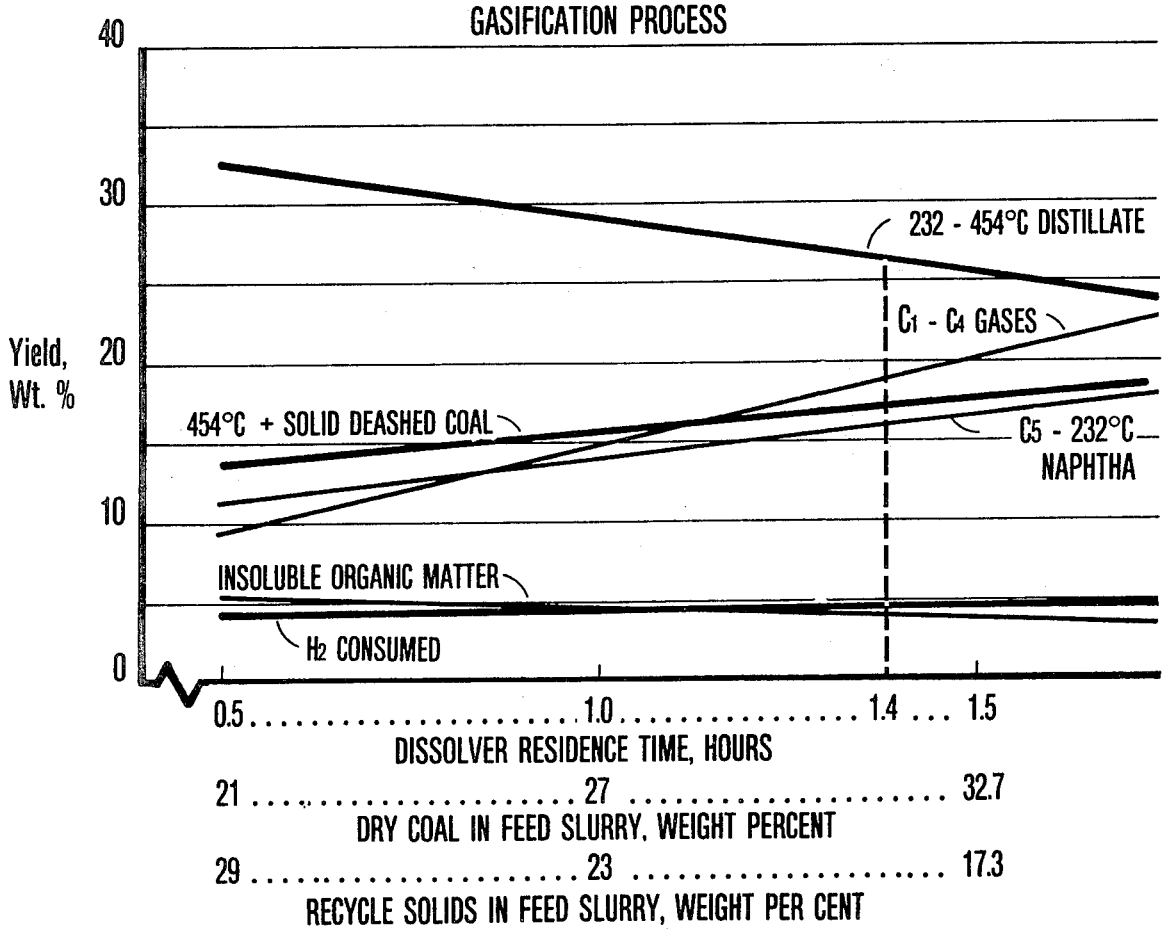

The residence time and other conditions prevailing in the dissolver step of the liquefaction zone regulate the hydrogenation and hydrocracking reactions occurring therein. In accordance with this invention these conditions are established so that the yield based on dry feed coal of 450° to 850° F. (232° to 454° C.) distillate liquid, which is the most desired product, is at least 35, 40, or 50 weight percent greater than the yield based on dry feed coal of 850° F.+(454° C.+) normally solid dissolved coal. FIGS. 1 and 2, discussed below, show that in the combination process of this invention with process conditions over the range shown providing this proportion of distillate liquid to normally solid dissolved coal, the yield of distillate liquid can be increased to an unexpectedly high level by a decrease in residence time.

It is shown below that in the combination process of this invention a relatively low dissolver residence time (i.e. small dissolver size) and a relatively low hydrogen consumption provide a product wherein the distillate liquid yield advantageously exceeds the yield of normally solid dissolved coal, by 35, 40 or 50 weight percent, or more, while a larger dissolver size and hydrogen consumption provide a product wherein the proportion of distillate liquid yield to normally solid dissolved coal is lower. It would have been expected that an elevated proportion of liquid coal to normally solid dissolved coal would require a relatively large dissolver size and a relatively large hydrogen consumption. It is a further advantage of the present invention that the elevated proportion of liquid coal to normally solid dissolved coal is achieved with a smaller gasifier than would be required with a lower proportion of liquid coal to normally solid dissolved coal.

The 450° to 850° F. (232° to 454° C.) distillate liquid fraction is the most valuable liquefaction zone product fraction. It is more valuable than the lower boiling naphtha product fraction because it is a premium fuel as recovered, while the naphtha product fraction requires upgrading by catalytic hydrotreating and reforming for conversion to gasoline, which is a premium fuel. The distillate fraction is more valuable than the higher boiling normally solid dissolved coal fraction because the higher boiling fraction is not a liquid at room temperature and contains mineral residue.

It is shown below that progressively increasing proportions of distillate liquid relative to normally solid dissolved coal are accompanied by progressively lower process hydrogen consumption levels. The opposite would have been expected. The reason for the hydrogen consumption decline resides in our discovery that in the combination process of this invention the selectivity advantage for distillate liquid in preference to normally solid dissolved coal is specific to the distillate liquid and is not also extended to lower boiling products such as naphtha and hydrocarbon gases. The increased distillate liquid yield obtained in accordance with the present invention is not only accompanied by a decline in the yield of normally solid dissolved coal but is also unexpectedly accompanied by a decline in the yield of naphtha and gaseous hydrocarbons. It is an unexpected feature of the present process that the yield of distillate liquid can progressively increase with decreases in residence time while the yields of all other major product fractions, including higher and lower boiling hydrocarbonaceous fractions, are declining.

The prior art has disclosed the combination of coal liquefaction and gasification in an article entitled "The SRC-II Process—Presented at the Third Annual International Conference on Coal Gasification and Liquefaction, University of Pittsburgh", Aug. 3-5, 1976 by B. K. Schmid and D. M. Jackson. This article shows a combination coal liquefaction-gasification process where organic material is passed from the liquefaction zone to the gasification zone for the production of the hydrogen required for the process. Table I of this article contains the only dissolver effluent data presented and by extrapolating these data it is found that the 450° to 850° F. (232° to 454° C.) distillate liquid yield is only about 27 percent greater than the yield of 850° F.+(454° C.+) normally solid dissolved coal. FIGS. 1 and 2, discussed below, show that a significant dissolver residence time (i.e. dissolver size) advantage of this invention requires at least a 35 or 40 percent and preferably at least a 50 percent yield advantage of 450° to 850° F. (232° to 454° C.) distillate liquid over 850° F.+(454° C.+) normally solid dissolved coal. Extrapolated data in Table 1 of this article also show that the yield of 450° to 850° F. (232° to 454° C.) distillate liquid, which is the most desired product fraction, is only about 25.65 weight percent. FIGS. 1 and 2, discussed below, show that this is below the maximum yield of this desirable product fraction obtainable in an uncoupled liquefaction process (27 weight percent), and that only by operation of a coupled liquefaction-gasification system to achieve the dissolver residence time advantage of this invention can a higher yield of distillate liquid be obtained.

The VTB contains essentially the entire net yield of mineral residue produced in the liquefaction zone as well as essentially the entire net yield of 850° +(454° C.+) normally solid dissolved coal of the liquefaction zone and, because all non-recycled VTB is passed to the gasifier zone, no step for the separation of mineral residue from dissolved coal, such as filtration, settling, gravity solvent-assisted settling, solvent extraction of hydrogen-rich compounds from hydrogen-lean compounds containing mineral residue or centrifugation is employed. The temperature of the gasifier is in the range 2,200° to 3,500° F. (1,204° to 1,982° C.) at which all mineral matter from the liquefaction zone is melted to form molten slag which is cooled and removed from the gasifier as a stream of solidified slag.

The use of a vacuum tower distillation unit in the present process insures separation of all normally liquid coal and hydrocarbon gases from the 850° F.+(454° C.+) normally solid dissolved coal prior to passage of the normally solid dissolved coal to the gasifier zone. The passage of any liquid coal to the partial oxidation gasifier zone would consitute a waste of the relatively great hydrogen consumption required to produce this premium fuel, with a consequent reduction in process efficiency. In contrast, normally solid dissolved coal is the coal fraction having the lowest hydrogen content, making it the optimum coal fraction for passage to the gasifier.

Mineral residue obtained from the liquefaction zone constitutes a catalyst for the solvation and selective hydrogenation and hydrocracking of dissolved coal to desirable products. The recycle of mineral residue to increase its concentration in the liquefaction zone results in an increase in the rate of selective hydrocracking of dissolved coal to desired products, thereby reducing the required slurry residence time in the dissolver and reducing the required size of the dissolver zone. The reduced residence time in the presence of increased mineral residue increases coal conversion and reduces the amounts of undesirable products formed, such as normally solid dissolved coal and hydrocarbon gases. The mineral residue is suspended in the dissolver effluent slurry in the form of very small particles about 1 to 20 microns in size, and the very small size of the particles enhances their catalytic activity via increased external surface area. The mineral residue is usually recycled in slurry with distillate liquid and normally solid dissolved coal. The recycled distillate liquid provides solvent for the process and the recycled normally solid dissolved coal allows this undesired product fraction a further opportunity to react while advantageously tending to reduce dissolver residence time.

The catalytic and other effects due to the recycle of mineral residue slurry can reduce by about one-half or even more the normally solid dissolved coal yield of the liquefaction zone, via selective hydrocracking of the dissolved coal, as well as inducing an increased removal of sulfur, nitrogen and oxygen. Therefore, mineral residue recycle has a substantial effect upon the efficiency of a combination liquefaction-gasification process. A similar degree of hydrocracking cannot be achieved satisfactorily by allowing the dissolver temperature to increase without restraint via the exothermic reactions occurring therein because excessive coke formation would result and selectivity and hydrogen consumption would suffer.

Use of an external catalyst in the liquefaction process is not equivalent to recycle of mineral residue because introduction of an external catalyst with the feed coal would increase process cost and make the process more complex, thereby reducing process efficiency, as contrasted to the use of an indiginous or in situ catalyst. Therefore, the present process does not require the addition of an external catalyst.

In the process of the present invention, the manner of coupling of the liquefaction and gasification zones and the employment of a recycle stream in the liquefaction zone are highly interdependent process features. The net yield of 850° F.+(454° C.+) normally solid dissolved coal obtained from the liquefaction zone constitutes the entire hydrocarbonaceous feed for the gasification zone. The gasification zone produces hydrogen and can also produce fuel for the combination process. The amount of 850° F.+(454° C.+) normally solid dissolved coal and UOM which the gasifier zone requires from the liquefaction zone will depend upon process hydrogen and fuel requirements. Process hydrogen and fuel requirements will therefore affect the relative mineral residue recycle to feed coal rate to the liquefaction zone because the recycle rate of mineral residue and of 850° F.+(454° C.+) normally solid dissolved coal will have a considerable effect upon the net yield of 850°

F.+(454° C.+) normally solid dissolved coal obtained from the liquefaction zone for passage to the gasification zone. Since recycle mineral residue constitutes a catalyst for the conversion of dissolved coal and the recycle of normally solid dissolved coal permits further conversion thereof, the net yield of normally solid dissolved coal and UOM which constitutes the entire hydrocarbonaceous feed for the gasifier zone will depend in large part upon the rate of recycle of mineral residue.

It is the fact that the net yield of normally solid dissolved coal and the rate of recycle of normally solid dissolved coal with suspended mineral residue mutually determine each other which accounts for the unusual product selectivity-residence time relationship illustrated in FIG. 2, which contrasts sharply with the product selectivity-residence time relationship shown in FIG. 1, representing a process wherein the mutual interaction is absent. Therefore, the elevated proportion of 450 to 850° F. (232 to 454° C.) distillate liquid to 850° F.+ (454° C.+) normally solid dissolved coal of this invention is critical only in a process wherein all of the 850° F.+ (454° C.+) normally solid dissolved coal and suspended mineral residue obtained from the liquefaction zone is either recycled or passed to the gasification zone to supply the entire hydrocarbonaceous feed to the gasification zone.

The process of the invention is subject to a constraint which considerably heightens the mutual interaction of the various process conditions. Because the mineral residue-containing recycle stream is mixed with the raw coal-containing feed slurry of the liquefaction zone, it is necessary to constrain the total solids content in the feed slurry at or near a maximum level. The total solids cannot exceed the constraint level because of pumpability problems. On the other hand, it is important to maintain the total solids at or near the maximum total solids level so that the process can have the benefit of the greatest possible amount of recycle mineral residue while maintaining a reasonable feed coal rate. Under a total solids constraint any increase in the rate of recycle of mineral residue will necessitate a decrease in the feed coal rate and vice versa.

In accordance with this invention liquefaction and gasification operations are coupled in a manner which provides a highly efficient operation. Even though a liquefaction process operates at a higher thermal efficiency than a gasification process at moderate yields of normally solid dissolved coal, U.S. Ser. No. 905,299, filed May 12, 1978, which is hereby incorporated by reference, reported that the efficiency of a combination coal liquefaction-gasification process is enhanced when the synthesis gas produced in the gasifier zone not only supplies the entire hydrogen requirement of the liquefaction zone but also supplies at least 5 to 10 percent and up to 100 percent on a heat basis of the total process energy requirement by direct combustion within the process of synthesis gas or a carbon monoxide-rich stream derived therefrom. The total energy requirement of the process includes electrical or other purchased energy, but does not include heat generated in the gasifier, because exothermic gasifier heat is considered to be heat of reaction. It is surprising that process efficiency can be enhanced by a limited increase in the amount of normally solid dissolved coal which is gasified, rather than by further conversion of said coal within the liquefaction zone, since coal gasification is known to be a less efficient method of coal conversion than coal liquefaction. It would be expected that putting an additional load upon the gasification zone, by requiring it to produce process energy in addition to process hydrogen, would reduce the efficiency of the combination process. Furthermore, it would be expected that it would be inefficient to feed to a gasifier a coal that has already been subjected to hydrogenation, as contrasted to raw coal, since the reaction in the gasifier is an oxidation reaction. In spite of these observations, above-mentioned U.S. Ser. No. 905,299, filed May 12, 1978, reported that the thermal efficiency of a combination liquefaction-gasification process is increased when the gasifier produces a significant amount of process fuel in the form of either synthesis gas or a carbon monoxide-rich stream derived from the synthesis gas, as well as process hydrogen. The aforementioned patent application reported that a high thermal efficiency was achieved when all, or at least 60 percent, on a combustion heating value basis, of the synthesis gas in excess of the amount required to produce process hydrogen, either as synthesis gas or as a carbon monoxide-rich stream derived from the synthesis gas, is utilized as fuel within the combination process without a hydrogenation or other conversion step. In the reported system, all or most of the synthesis gas produced is consumed in the process, both as a reactant and as a fuel, without conversion to another fuel such as methane or methanol. The synthesis gas can be subjected to an acid gas removal step or to a step for the separation of CO from $H_2$ prior to use.

Because gasifiers are generally unable to oxidize all of the hydrocarbonaceous fuel supplied to them and some is unavoidably lost as coke in the removed slag, gasifiers tend to operate at a higher efficiency with a hydrocarbonaceous feed in the liquid state than with a solid carbonaceous feed, such as coke. Since coke is a solid degraded hydrocarbon, it cannot be gasified at as near to a 100 percent efficiency as a liquid hydrocarbonaceous feed so that more is lost in the molten slag formed in the gasifier than in the case of a liquid gasifier feed, which would constitute an unnecessary loss of carbonaceous material from the system. Therefore, the employment of a coker between the dissolver and the gasification zones would reduce the efficiency of the combination process. The total yield of coke (excluding UOM) in the present process is well under one weight percent, and is usually less than one-tenth weight percent, based on dry feed coal. Whatever the gasifier feed, enhanced oxidation thereof is favored with increasing gasifier temperatures. Therefore, high gasifier temperatures are required to achieve a high process efficiency. The maximum gasifier temperatures of this invention are in the range 2,200° to 3,600° F. (1,204° to 1,982° C.), generally; 2,300° to 3,200° F. (1,260° to 1,760° C.), preferably; and 2,400° or 2,500° to 3,200° F. (1,316° or 1,371° to 1,760° C.), more preferably.

Although the VTB slurry passed to the gasifier is essentially water-free, controlled amounts of water or steam are charged to the gasifier to produce CO and $H_2$ by an endothermic reaction between water and the carbonaceous feed. This reaction consumes heat, whereas the reaction of carbonaceous feed with oxygen to produce CO generates heat. In a gasification process wherein $H_2$ is the only desired gasifier product, such as where a shift reaction, a methanation reaction, or a methanol conversion reaction follows the gasification step, the introduction of a large amount of water would be beneficial. However, in the process of this invention wherein a considerably quantity of synthesis gas can be advantageously utilized directly as process fuel, as explained above, the production of hydrogen is of diminished benefit as compared to the production of CO, since $H_2$ and CO have about the same heat of combustion. Although the elevated gasifier temperatures of this invention advantageously encourage nearly complete oxidation of carbonaceous feed, the product equilibrium at these high gasifier temperatures favors a synthesis gas product with a mole ratio of $H_2$ to CO of less than one; even less than 0.8 or 0.9; or even less than 0.6 or 0.7. However, as explained above, this equilibrium is not a detriment in the process of this invention where carbon monoxide can be employed as a process fuel.

All of the raw feed coal for the combination process is pulverized, dried and mixed with hot solvent-containing recycle slurry. The recycle slurry is generally considerably more dilute than the slurry passed to the gasifier zone because it is generally not vacuum distilled and it contains a considerable quantity of 450 to 850° F. (232 to 454° C.) distillate liquid, which performs a solvent function. One to four parts, preferably 1.5 to 2.5 parts, on a weight basis of recycle slurry are employed to one part of raw coal. The recycled slurry, hydrogen and raw coal are passed through a fired tubular preheater zone, and then to a reactor or dissolver zone. The ratio of hydrogen to raw coal is in the range 20,000 to 80,000 SCF per tone (0.62 to 2.48 $M^3$/kg), and is preferably 30,000 to 60,000 SCF per ton (0.93 to 1.86 $M^3$/kg).

In the preheater the temperature of the reactants gradually increases so that the preheater outlet temperature is in the range 680 to 820° F. (360° to 438° C.), preferably about 700° to 760° F. (371° to 404° C.). The coal is partially dissolved at this temperature and exothermic hydrogenation and hydrocracking reactions are beginning. The heat generated by these exothermic reactions in the dissolver, which is backmixed and is at a relatively uniform temperature, raises the temperature of the reactants further to the range 800° to 900° F. (427° to 482° C.), preferably 840° to 870° F. (449° to 466° C.). The residence time in the dissolver zone is longer than in the preheater zone. The dissolver temperature is at least 20, 50, 100 or even 200° F. (11.1, 27.1, 55.5 or even 111.1° C.), higher than the outlet temperature of the preheater. The hydrogen pressure in the preheating and dissolver steps is in the range 1,000 to 4,000 psi (70 to 280 kg/$cm^2$), and is preferably 1,500 to 2,500 psi (150 to 175 kg/$cm^2$). The hydrogen is added to the slurry at one or more points. At least a portion of the hydrogen is added to the slurry prior to the inlet of the preheater. Additional hydrogen may be added between the preheater and dissolver and/or as quench hydrogen in the dissolver itself. Quench hydrogen is injected at various points when needed in the dissolver to maintain the reaction temperature at a level which avoids significant coking reactions.

Figure 3:
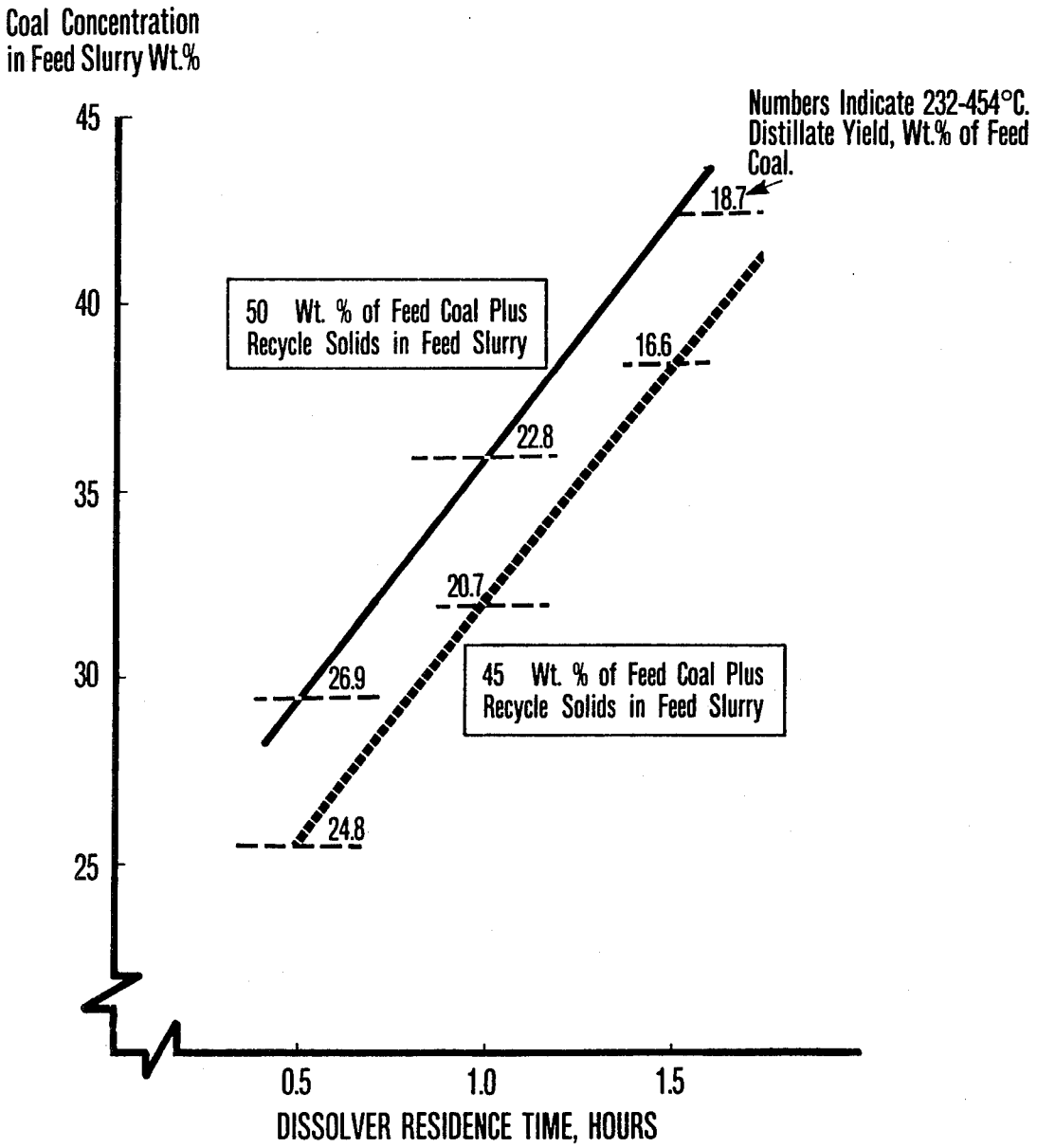
Figure 4:
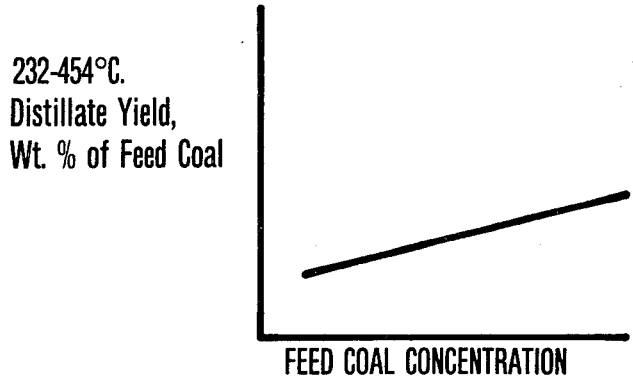
Figure 5:
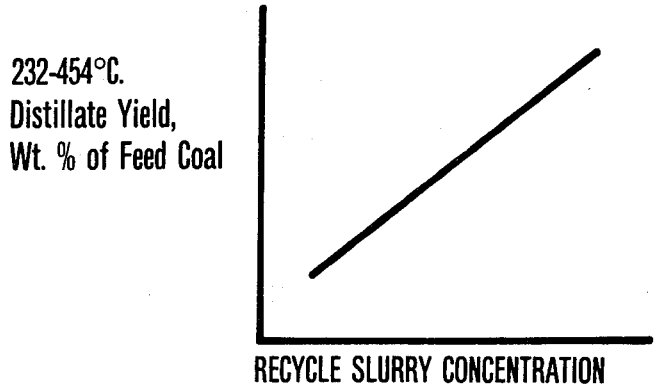
Figure 6:
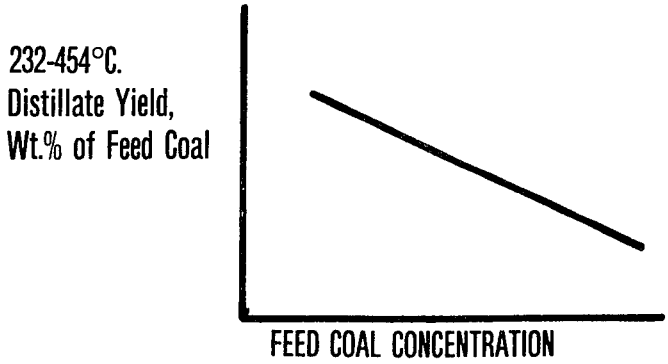
Figure 7:
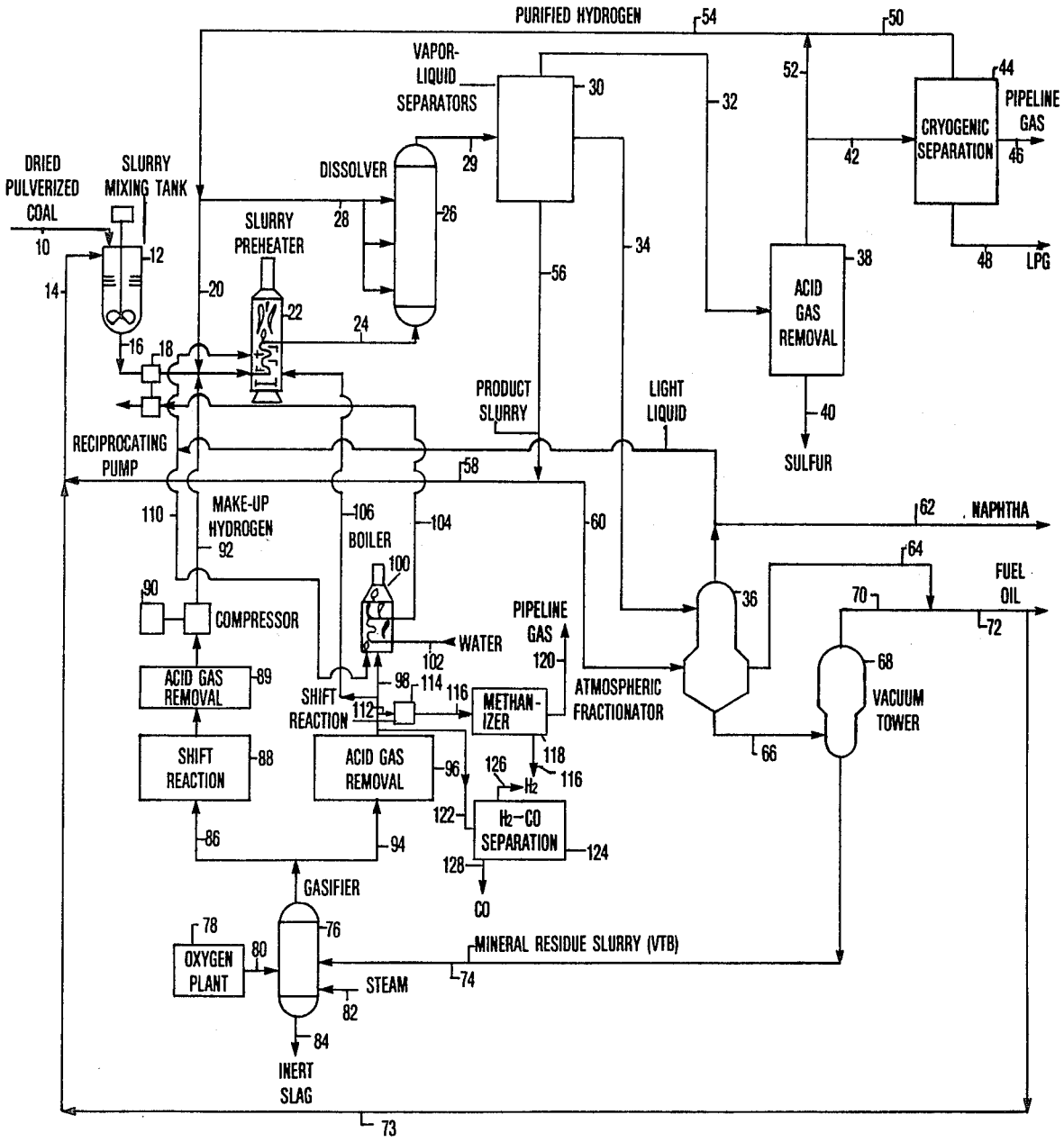

The present invention is illustrated in the accompanying figures in which:

FIG. 1 graphically shows the distribution at various residence times of product fractions in a coal liquefaction process uncoupled with a gasifier;

FIG. 2 graphically shows the distribution of product fractions at various residence times and recycle slurry ratios in a coal liquefaction process coupled with a gasifier;

FIG. 3 graphically shows the effect of the total solids level in the feed slurry to a coal liquefaction process;

FIGS. 4, 5 and 6 graphically show the effect upon distillate yield of changes in the type of solids in the feed slurry to a coal liquefaction process; and FIG. 7 shows a scheme for performing the process of the present invention.

FIGS. 1 and 2 contain graphical presentations which illustrate the present invention. FIG. 1 represents a coal liquefaction process uncoupled with a gasifier. FIG. 2 represents a coupled coal liquefaction-gasification process of this invention. These figures relate dissolver slurry residence time to the weight percentage yield of 450°–850° F. (232°–454° C.) distillate liquid and to the weight percentage yield of 850° F.+ (454° C.+) normally solid dissolved coal, based on dry feed coal. FIGS. 1 and 2 also show the weight percentage yields at various residence times of $C_1$ to $C_4$ gases; $C_5$—450° F. (232° C.) naphtha; insoluble organic matter; and the weight percent of hydrogen consumed, based on feed coal. The yields shown in FIGS. 1 and 2 are net yields on a weight basis of the liquefaction zone, based on moisture-free feed coal, obtained after removing all recycle material from the liquefaction zone effluent stream. The dissolver of the processes of both FIGS. 1 and 2 was operated at a temperature of 860° F. (460° C.) and at a hydrogen pressure of 1700 psi (119 kg/$cm^2$), dissolver residence time being the only process condition varied without restraint. The processes illustrated in FIGS. 1 and 2 both observed a 50 weight percent total solids constraint for the feed slurry, including raw feed coal and recycle mineral residue slurry. This total solids level is close to the upper limit of pumpability of the feed slurry.

In the process of FIG. 1 the solids concentration of the feed slurry is fixed at 30 weight percent feed coal and 20 weight percent recycle solids. The ratio of feed coal to recycle solids can be held constant in the process of FIG. 1 because in that process the liquefaction operation is not coupled to a gasification operation, i.e. the VTB is not fed to a gasifier. In the process of FIG. 2, while the total solids content of the feed slurry is held at 50 weight percent, the proportions of coal and recycle solids in the feed slurry vary because the liquefaction zone is coupled with a gasifier, including a shift reactor for the production of process hydrogen, in a manner such that dissolver effluent solids are passed to the gasifier (as VTB) in the precise amount permitting the gasifier to supply the total hydrogen requirement of the liquefaction zone. In the system of FIG. 2, the amount of solids-containing slurry available for recycle, as well as the ratio of feed coal to recycle solids, are determined by the amount of solids-containing slurry required by the gasifier.

FIG. 1 shows that when the liquefaction and gasifier zones are not coupled, but the liquefaction zone is provided with a product recycle stream, the 450°–850° F. 232–454° C.) distillate liquid yield remains stable at about 27 weight percent, based on feed coal, with increased residence time of over the period shown, while the yield of 850° F.+ (454° C.+) solid deashed coal declines with increased residence time. FIG. 1 shows that the yield of distillate liquid, which is the most desired product fraction, cannot be increased above 27 weight percent regardless of residence time. FIG. 1 further shows that the yield of 450°–850° F. (232°–454° C.) liquid coal, which is the most desired product fraction, is at least 50 percent greater than the yield of solid deashed coal only at dissolver residence times of 1.15 hours and greater. The dashed vertical line of FIG. 1 shows that at a residence time of 1.15 hours, the yield of solid deashed coal is about 18 weight percent and the yield of distillate oil is about 27 weight percent, i.e. about 50 percent higher. The 50 percent yield advantage of liquid coal over normally solid dissolved coal declines at residence times below 1.15 hours, but increases at residence times above 1.15 hours and less than about 1.5 hours.

Referring now to FIG. 2, which illustrates a process wherein the liquefaction zone is coupled to a gasifier and wherein the liquefaction zone is provided with a product recycle stream, the dashed vertical line shows that a 50 percent yield advantage for the liquid coal over normally solid dissolved coal is achieved at a dissolver residence time of 1.4 hours. At a dissolver residence time of 1.4 hours, the normally solid dissolved coal yield is about 17.5 weight percent while the liquid coal yield is about 26.25 weight percent, i.e. about 50 percent greater. The same yield advantage in favor of distillate liquid is achieved at the lower residence time of 1.15 hours in an uncoupled system. There is therefore a relative disadvantage in terms of dissolver size, which may not be compensated for by a smaller gasifier size, in performing a coupled liquefaction-gasifier operation unless the yield advantage of liquid coal over normally solid coal is considerable, i.e. at least 35, 40 or 50 weight percent, or more. This relative disadvantage in the coupled system increases with increasing dissolver residence times because in the coupled system as residence times progressively increase the yield advantage of liquid coal over normally solid dissolved coal progressively falls. In contrast, FIG. 1 shows that in an uncoupled system the yield advantage of liquid coal over normally solid dissolved coal progressively increases with increases in residence time to values above 1.15 hours and less than about 1.5 hours.

It is noted that the liquid coal yield and normally solid dissolved coal yield at the dashed vertical line of FIG. 2 each correspond very closely to the respective yield of the corresponding product at the dashed vertical line of FIG. 1. However, a particular significance of the process condition at the dashed vertical line of FIG. 2 is that any significant reduction in dissolver residence time will increase the yield of 450°-850° F. (232°-454° C.) liquid coal product fraction to a level above the yield of 450°-850° F. (232°-454° C.) liquid coal obtainable in the process of FIG. 1, regardless of dissolver residence time. Significantly, it is a reduction, not an increase, in residence time at the process condition represented by the dashed vertical line of FIG. 2 that will increase the yield of the 450°-850° F. (232°-454° C.) liquid coal fraction to a level above the maximum which can be achieved regardless of dissolver residence time in the process of FIG. 1 (i.e. above 27 weight percent, preferably above 28, 29 or 30 weight percent). It is noted that the extrapolated yield of 450°-850° F. (232°-454° C.) liquid coal yield shown in Table 1 of the above-cited literature reference is only about 25.65, which is below the 27 weight percent yield of this fraction obtained in the uncoupled liquefaction process of FIG. 1.

The showing in FIG. 2 that in the coupled liquefaction-gasification system the yield advantage in favor of distillate liquid over normally solid dissolved coal increases above 50 percent as dissolver residence times fall below 1.4 hours is not only surprising but it is diametrically opposite to the showing of FIG. 1 wherein the 50 percent yield advantage for distillate liquid progressively declines as residence time fall below 1.15 hours. FIG. 2 shows that the advantage of this invention in terms of both reduced dissolver size and reduced hydrogen consumption progressively increases as the dissolver residence time decreases below 1; below 0.8; or even about 0.5 hours, or lower.

It is an important showing of FIG. 2 that progressively increasing ratios of liquid coal to normally solid dissolved coal are accompanied by a progressively lower hydrogen consumption, indicating a smaller required gasifier size. This is surprising and, as noted above, the reason is that in the combination process the selectively advantage is directed specifically towards the yield of distillate liquid. FIG. 2 shows that the increase in liquid coal yield is not only accompanied by a decline in the yield of solid deashed coal but is also unexpectedly accompanied by a decline in the yield of naphtha and gaseous hydrocarbons. Therefore, unexpectedly, the liquid coal yield progressively increases while the yield of all other products, including both higher and lower boiling products, are declining.

The process of the above cited literature reference involves the coupling of liquefaction and gasification operations to provide a hydrogen balanced system. Table I of the reference presents the only dissolver effluent data contained in the reference. Extrapolating these data, it is found that in the process of the reference the 450°-850° F. (232°−454° C.) distillate oil yield is only about 27 weight percent greater than the yield of 850° F.+(454° C.+) solid deashed coal. FIG. 2 herein shows that in the coupled system of this invention a 27 weight percent yield advantage of 450°-850° F. (232°-454° C.) liquid coal over 850° F.+(454° C.+) normally solid dissolved coal requires a dissolver residence time near 1.9 hours, which would necessitate a dissolver size about one-third larger than the required dissolver size at a more desirable 50 percent yield advantage. FIG. 2 shows that reductions in dissolver residence times are achieved when the yield advantage of 450° to 850° F. (232° to 454° C.) liquid coal over 850° F.+ (454° C.+) normally solid dissolved coal increases above 27 weight percent to at least 60, 70, or 80, or even to 100 weight percent, or more.

We have discovered the reason for the surprising effect of residence time upon the relative yields of liquid coal and normally solid dissolved coal in the coupled coal liquefaction-gasification system of this invention. This discovery is partially illustrated in FIG. 2 which shows the dry coal concentration and the recycle solids (recycle mineral residue) concentration, respectively, in the feed slurry at three different dissolver residence times in the coupled system having a total solids constraint for the feed slurry of 50 weight percent. As shown in FIG. 2, diminishing dissolver residence times are accompanied by an increasing recycle solids concentration and a decreasing dry coal concentration respectively, in the feed slurry, indicating the beneficial effect of high recycle solids levels. This discovery is further illustrated in FIG. 3 which shows data relating to a coupled liquefaction-gasification system in hydrogen balance and utilizing product recycle to a feed slurry mixing tank having a total solids constraint. FIG. 3 shows that under the constraints of such a system a reduction in dissolver residence time induces an increased liquid coal yield because an increased concentration of recycle mineral residue is induced in the feed slurry, which is inherent in the indicated reduction in coal concentration at a constant total solids level. The numbers on the interior of FIG. 3 show the yields of 450° to 850° F. (232° to 454° C.) distillate liquid obtained at various residence times at two constraint levels of feed coal plus recycle solids (50 and 45 weight percent) in the feed slurry. FIG. 3 shows that the distillate liquid yield increases at each of the two constraint total solids levels shown with decreases in dissolver residence time. Since FIG. 3 surprisingly shows that in the constrained system the increase in the yield of distillate liquid is accompanied by a decreased concentration of raw coal in the feed slurry and since the total solids level in the feed slurry is held constant along each of the two lines on FIG. 3, FIG. 3 inherently shows that the increases in the yield of liquid coal were induced by increases in the ratio of recycle mineral residue to raw coal in the feed slurry.

The showing in FIGS. 2 and 3 is expanded in FIGS. 4, 5 and 6. FIG. 4 shows the effect of increases in the concentration of raw coal in the feed slurry upon the yield of liquid coal, at a constant concentration of recycle slurry. FIG. 5 shows the effect of increases in the concentration of recycle mineral residue in the feed slurry upon the yield of distillate liquid, at a constant concentration of raw feed coal. Finally, FIG. 6 shows the effect of changes in the concentration of raw coal in the feed slurry when the raw coal is contained in a feed slurry in which the total concentration of feed coal plus recycle solids remains constant.

A comparison of FIGS. 4 and 5 shows that an increase in feed coal concentration and in recycle slurry concentration in the feed slurry each tends to increase the yield of distillate liquid but that the effect of a change in recycle slurry concentration upon the yield of distillate liquid is about triple the effect of a change in the feed coal concentration. FIG. 6 combines the data of FIGS. 4 and 5 by showing that any increase in feed coal concentration which occurs at the expense of recycle solids, i.e. when there is a total solids constraint, actually has a negative effect on distillate liquid yield.

A scheme for performing the combination process of this invention is illustrated in FIG. 7. Dried and pulverized raw coal, which is the entire raw coal feed for the process, is passed through line 10 to slurry mixing tank 12 wherein it is mixed with hot solvent-containing recycle slurry from the process flowing in line 14. The solvent-containing recycle slurry mixture (in the range 1.5–2.5 parts by weight of slurry to one part of coal) in line 16 is maintained at a constraint total solids level of about 50 to 55 weight percent and is pumped by means of reciprocating pump 18 and admixed with recycle hydrogen entering through line 20 and with make-up hydrogen entering through line 92 prior to passage through tubular preheater furnace 22 from which it is discharged through line 24 to dissolver 26. The ratio of hydrogen to feed coal is about 40,000 SCF/ton (1.24 $M^3$/kg).

The temperature of the reactants at the outlet of the preheater is about 700° to 760° F. (371° to 404° C.). At this temperature the coal is partially dissolved in the recycle solvent, and the exothermic hydrogenation and hydrocracking reactions are just beginning. Whereas the temperature gradually increases along the length of the preheater tube, the dissolver is at a generally uniform temperature throughout and the heat generated by the hydrocracking reactions in the dissolver raise the temperature of the reactants to the range 840°–870° F. (449°–466° C.). Hydrogen quench passing through line 28 is injected into the dissolver at various points to control the reaction temperature and reduce the impart of exothermic reactions.

The dissolver effluent passes through line 29 to vapor-liquid separator system 30. The hot overhead vapor stream from these separators is cooled in a series of heat exchangers and additional vapor-liquid separation steps and removed through line 32. The liquid distillate from these separators passes through line 34 to atmospheric fractionator 36. The non-condensed gas in line 32 comprises unreacted hydrogen, methane and other light hydrocarbons, plus $H_2S$ and $CO_3$, and is passed to acid gas removal unit 38 for removal of $H_2S$ and $CO_2$. The hydrogen sulfide recovered is converted to elemental sulfur which is removed from the process through line 40. A portion of the purified gas is passed through line 42 for further processing in cryogenic unit 44 for removal of much of the methane and ethane as pipeline gas which passes through line 46 and for the removal of propane and butane as LPG which passes through line 48. The pipeline gas in line 46 and the LPG in line 48 represent the net yields of these materials from the process. The purified hydrogen (90 percent pure) in line 50 is blended with the remaining gas from the acid gas treating step in line 52 and comprises the recycle hydrogen for the process.

The liquid slurry from vapor-liquid separators 30 passes through line 56 and is split into two major streams, 58 and 60. Stream 58 comprises the recycle slurry containing solvent, normally solid dissolved coal and catalytic mineral residue. The non-recycled portion of this slurry passes through line 60 to atmospheric fractionator 36 for separation of the major products of the process.

In fractionator 36 the slurry product is distilled at atmospheric pressure to remove an overhead naphtha stream through line 62, a middle distillate stream through line 64 and a bottoms stream through line 66. The naptha in stream 62 represents the net yield of naphtha from the process. The bottoms stream in line 66 passes to vacuum distillation tower 68. The temperature of the feed to the fractionation system is normally maintained at a sufficiently high level that no additional preheating is needed, other than for startup operations. A blend of the fuel oil from the atmospheric tower in line 64 and the middle distillate recovered from the vacuum tower through line 70 makes up the major fuel oil product of the process and is recovered through line 72. The stream in line 72 comprises 450°–850° F. (232°–454° C.) distillate fuel liquid product and a portion thereof can be recycled to feed slurry mixing tank 12 through line 73 to regulate the solids concentration in the feed slurry and the coal-solvent ratio. Recycle stream 73 imparts flexibility to the process by allowing variability in the ratio of solvent to slurry which is recycled, so that this ratio is not fixed for the process by the ratio prevailing in line 58. It also can improve the pumpability of the slurry. The portion of stream 72 that is not recycled through line 73 represents the net yield of distillate liquid from the process.

The bottoms from the vacuum tower, consisting of all non-recycled normally solid dissolved coal, undissolved organic matter and mineral matter, without any distillate liquid or hydrocarbon gases, is passed through line 74 to partial oxidation gasifier zone 76. Since gasifier 76 is adapted to receive and process a hydrocarbonaceous slurry feed stream, there should not be any hydrocarbon conversion step between vacuum tower 68 and gasifier 76, such as a coker, which will destroy the slurry and necessitate reslurrying in water. The amount of water required to slurry coke is greater than the amount of water ordinarily required by the gasifier so that the efficiency of the gasifier will be reduced by the amount of heat wasted in vaporizing the excess water. Nitrogen-free oxygen for gasifier 76 is prepared in oxygen plant 78 and passed to the gasifier through line 80. Steam is supplied to the gasifier through line 82. The entire mineral content of the feed coal supplied through line 10 is eliminated from the process as inert slag through line 84, which discharges from the bottom of gasifier 76. Synthesis gas is produced in gasifier 76 and a portion thereof passes through line 86 to shift reactor zone 88 for conversion by the shift reaction wherein steam and CO is converted to $H_2$ and $CO_2$, followed by an acid gas removal zone 89 for removal of $H_2S$ and $CO_2$. The purified hydrogen obtained (90 to 100 percent pure) is then compressed to process pressure by means of compressor 90 and fed through line 92 as make-up hydrogen for preheater zone 22 and dissolver 26.

The amount of synthesis gas produced in gasifier 76 can be sufficient to supply all the molecular hydrogen required by the process but, preferably, is sufficient to also supply, without a methanation step, between 5 and 100 percent of the total heat and energy requirement of the process. To this end, the portion of the synthesis gas that does not flow to the shift reactor passes through line 94 to acid gas removal unit 96 wherein $CO_2+H_2S$ are removed therefrom. The removal of $H_2S$ allows the synthesis gas to meet the environmental standards required of a fuel while the removal of $CO_2$ increases the heat of combustion of the synthesis gas so that finer heat control can be achieved when it is utilized as a fuel. A stream of purified synthesis gas passes through line 98 to boiler 100. Boiler 100 is provided with means for combustion of the synthesis gas as a fuel. Water flows through line 102 to boiler 100 wherein it is converted to steam which flows through line 104 to supply process energy, such as to drive reciprocating pump 18. A separate stream of synthesis gas from acid gas removal unit 96 is passed through line 106 to preheater 22 for use as a fuel therein. The synthesis gas can be similarly used at any other point of the process requiring fuel. If the synthesis gas does not supply all of the fuel required for the process, the remainder of the fuel and the energy required in the process can be supplied from any non-premium fuel stream prepared directly within the liquefaction zone. If it is more economic, some or all of the energy for the process, which is not derived from synthesis gas, can be derived from a source outside of the process, not shown, such as from electric power.

Additional synthesis gas can be passed through line 112 to shift reactor 114 to increase the ratio of hydrogen to carbon monoxide from about 0.6 to about 3. This enriched hydrogen mixture is then passed through line 116 to methanation unit 118 for conversion to pipeline gas, which is passed through line 120 for mixing with the pipeline gas in line 46. If the process is to achieve a high thermal efficiency, the amount of pipeline gas based on heating value passing through line 120 will be 40 percent or less than the amount of synthesis gas used as process fuel passing through lines 98 and 106.

A portion of the purified synthesis gas stream is passed through line 122 to a cryogenic separation unit 124 wherein hydrogen and carbon monoxide are separated from each other. An adsorption unit can be used in place of the cryogenic unit. A hydrogen-rich stream is recovered through line 126 and can be blended with the make-up hydrogen stream in line 92, independently passed to the liquefaction zone or sold as a product of the process. A carbon monoxide-rich stream is recovered through line 128 and can be blended with synthesis gas employed as process fuel in line 98 or in line 106, or can be sold or used independently as process fuel or as a chemical feedstock.

FIG. 7 shows that the gasifier section of the process is highly integrated into the liquefaction section. The entire feed to the gasifier section (VTB) is derived from the liquefaction section and all or most of the gaseous product of the gasifier section is consumed within the process, either as a reactant or as a fuel.

We claim:

1. A combination coal liquefaction-gasification process comprising passing mineral-containing feed coal, hydrogen, recycle dissolved liquid coal solvent, recycle dissolved coal which is solid at room temperature and recycle mineral residue to a coal liquefaction zone to dissolve hydrocarbonaceous material from mineral residue and to hydrocrack said hydrocarbonaceous material to produce a liquefaction zone effluent mixture comprising hydrocarbon gases, dissolved liquid coal, solid dissolved coal and suspended mineral residue; recycling to said liquefaction zone a portion of said dissolved liquid coal, solid dissolved coal and mineral residue; the ratio of said recycle portion to said feed coal being established so that the net yield after recycle based on dry feed coal of solid dissolved coal is 17.5 weight percent or lower and the net yield after recycle based on dry feed coal of 450° to 850° F. dissolved liquid coal is at least 35 weight percent greater than the net yield of solid dissolved coal; separating dissolved liquid coal and hydrocarbon gases from solid dissolving coal and mineral residue to produce a gasifier feed slurry comprising substantially the entire net yield of solid dissolved coal and mineral residue of said liquefaction zone; passing said gasifier feed slurry to a gasification zone including an oxidation zone for the conversion of the hydrocarbonaceous material therein to synthesis gas; converting at least a portion of said synthesis gas to a gaseous hydrogen-rich stream and passing said hydrogen-rich stream to said liquefaction zone to supply process hydrogen thereto; the amount of carbonaceous material passed to said gasification zone being sufficient to enable said gasification zone to produce at least the entire hydrogen requirement of said liquefaction zone.

2. The process of claim 1 wherein said net yield of 450° to 850° F. dissolved liquid is at least 50 weight percent greater than the net yield of 850° F.+ solid dissolved coal.

3. The process of claim 1 wherein said net yield based on feed coal of 450° to 850° F. dissolved liquid coal is at least 60 percent greater than the net yield of 850° F.+ solid dissolved coal.

4. The process of claim 1 wherein said net yield based on feed coal of 450° to 850° F. dissolved liquid coal is at least 80 percent greater than the net yield of 850° F.+ solid dissolved coal.

5. The process of claim 1 wherein said liquefaction zone comprises preheater and dissolver steps in series, and the residence time in said dissolver step is less than 1.4 hours.

6. The process of claim 1 wherein the amount of hydrocarbonaceous material passed to said gasification zone is sufficient to enable said gasification zone to produce an excess amount of synthesis gas beyond the amount required to produce the hydrogen in said hydrogen-rich stream.

7. The process of claim 1 wherein said separation of dissolved liquid coal and hydrocarbon gases from solid dissolved coal and mineral residue is performed in a vacuum distillation zone.

8. The process of claim 1 wherein said gasifier feed slurry comprises substantially the entire hydrocarbonaceous feed to said gasification zone.

9. The process of claim 1 including the removal of mineral residue as slag from said gasification zone.

10. The process of claim 1 wherein there is no solids-liquid separation step for the separation of mineral residue from solid dissolved coal.

11. The process of claim 1 wherein the maximum temperature in said gasification zone is between about 2,200° and 3,600° F.

12. The process of claim 1 wherein the total coke yield in said liquefaction zone is less than 1 weight percent, based on feed coal.

13. The process of claim 1 wherein the mol ratio of $H_2$ to CO in said synthesis gas is less than 1.

14. The process of claim 1 wherein said net yield of 450° to 850° F. dissolved liquid coal is above 27 weight percent based on dry feed coal.

15. The process of claim 1 wherein said conversion of a portion of said synthesis gas to a hydrogen-rich stream occurs in a shift reactor.

16. The process of claim 5 wherein said dissolver residence time is less than 1 hour.

17. The process of claim 5 wherein said dissolver residence time is less than 0.5 hour.

18. The process of claim 6 wherein the total heat of combustion of said excess amount of synthesis gas is energy requirement of said combination process; and burning said additional amount of synthesis gas as fuel in said combination process.

19. The process of claim 6 including burning as fuel in said combination process a portion of said excess amount of synthesis gas, said portion comprising at least 60 mol percent of the total CO plus $H_2$ content of said excess amount of synthesis gas, and said portion supplying between 5 and 100 percent on a heat basis of the total energy requirement of said combination process.

20. A combination coal liquefaction-gasification process comprising passing mineral-containing feed coal, hydrogen, recycle dissolved liquid coal solvent, recycle dissolved coal which is solid at room temperature and recycle mineral residue to a coal liquefaction zone to dissolve hydrocarbonaceous material from mineral residue and to hydrocrack said hydrocarbonaceous material to produce a liquefaction zone effluent mixture comprising hydrocarbon gases, dissolved liquid coal, solid dissolved coal and suspended mineral residue; recycling to said liquefaction zone a portion of said dissolved liquid coal, solid dissolved coal and mineral residue; the ratio of said recycle portion to said feed coal being established so that the net yield after recycle based on dry feed coal of solid dissolved coal is 17.5 weight percent or lower and the net yield after recycle based on dry feed coal of 450° to 850° F. dissolved liquid coal is above 27 weight percent; separating dissolved liquid coal and hydrocarbon gases from solid dissolved coal and mineral residue to produce a gasifier feed slurry comprising substantially the entire net yield of solid dissolved coal and mineral residue of said liquefaction zone; passing said gasifier feed slurry to a gasification zone including an oxidation zone for the conversion of the hydrocarbonaceous material therein to synthesis gas; converting at least a portion of said synthesis gas to a gaseous hydrogen-rich stream and passing said hydrogen-rich stream to said liquefaction zone to supply process hydrogen thereto; the amount of carbonaceous material passed to said gasification zone being sufficient to enable said gasification zone to produce at least the entire hydrogen requirement of said liquefaction zone.

21. The process of claim 20 wherein said net yield of 450° to 850° F. dissolved liquid coal is above 28 weight percent.

22. The process of claim 20 wherein said net yield of 450° to 850° F. dissolved liquid coal is above 30 weight percent.

* * * * *